US006669436B2

(12) United States Patent
Liu

(10) Patent No.: US 6,669,436 B2
(45) Date of Patent: Dec. 30, 2003

(54) GAS COMPRESSION APPARATUS AND METHOD WITH NOISE ATTENUATION

(75) Inventor: Zheji Liu, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 10/086,744

(22) Filed: Feb. 28, 2002

(65) Prior Publication Data

US 2003/0161717 A1 Aug. 28, 2003

(51) Int. Cl.[7] ..... F04D 29/44

(52) U.S. Cl. ..... 415/1; 415/119; 415/208.3; 181/286

(58) Field of Search ..... 415/1, 119, 208.2, 415/208.3, 211.2; 181/286

(56) References Cited

U.S. PATENT DOCUMENTS 4,106,587 A 8/1978 Nash et al.
4,421,455 A 12/1983 Tomren
4,433,751 A 2/1984 Bonneau
4,531,362 A 7/1985 Barry et al.
4,743,161 A 5/1988 Fisher et al.
4,858,721 A 8/1989 Autie et al.
4,930,979 A 6/1990 Fisher et al.
4,932,835 A 6/1990 Sorokes
5,340,275 A 8/1994 Eisinger
5,979,593 A 11/1999 Rice et al.
6,196,789 B1 3/2001 McEwen et al.
6,550,574 B2 * 4/2003 Liu ..... 181/286

* cited by examiner

*Primary Examiner*—Edward K. Look
*Assistant Examiner*—Kimya N. McCoy
(74) *Attorney, Agent, or Firm*—Haynes and Boone, LLP.

(57) ABSTRACT

A gas compression apparatus and method according to which an impeller rotates to flow fluid through a casing, and a plurality of vanes are mounted on a plate in the casing. A series of cells are formed in the plate to form an array of acoustic resonators to attenuate acoustic energy generated by the impeller.

21 Claims, 2 Drawing Sheets

GAS COMPRESSION APPARATUS AND METHOD WITH NOISE ATTENUATION

BACKGROUND

This invention is directed to a gas compression apparatus and method in which the acoustic energy caused by a rotating impeller is attenuated.

Gas compression apparatus, such as centrifugal compressors, are widely used in different industries for a variety of applications involving the compression, or pressurization, of a gas. These type of compressors utilize an impeller adapted to rotate in a casing at a relatively high rate of speed to compress the gas. However, a typical compressor of this type produces a relatively high noise level, caused at least in part, by the rotating impeller, which is an obvious nuisance and which can cause vibrations and structural failures.

DETAILED DESCRIPTION

Figure 1:
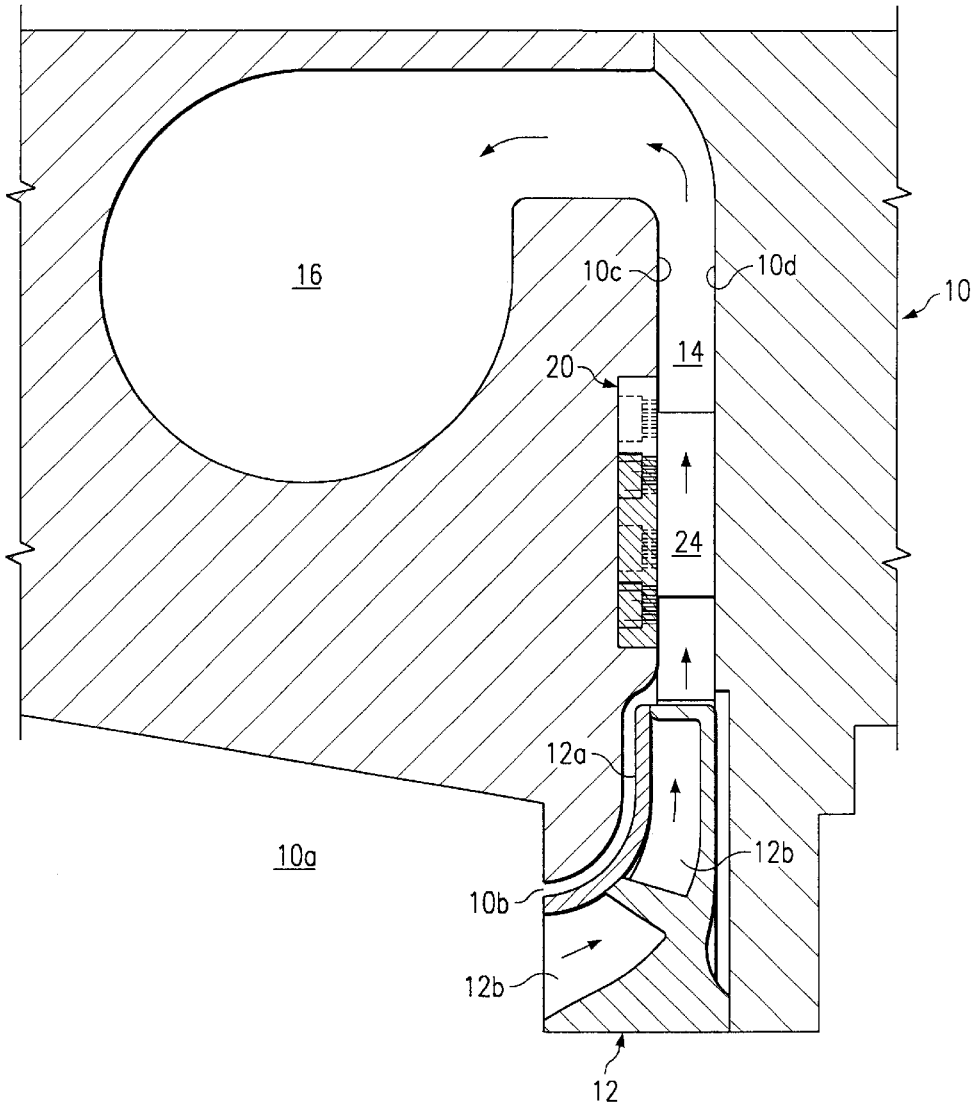
FIG. 1 is a cross-sectional view of a portion of a gas compression apparatus incorporating acoustic attenuation according to an embodiment of the present invention.

FIG. 1 depicts a portion of a high pressure, gas compression apparatus, such as a centrifugal compressor, including a casing 10 having an inlet 10*a* fluid to be compressed, and an impeller cavity 10*b* for receiving an impeller 12 which is mounted for rotation in the cavity. It is understood that a power-driven shaft (not shown) rotates the impeller 12 at a high speed, sufficient to impart a velocity pressure to the gas drawn into the casing 10 via an inlet 10*a*. The casing 10 extends completely around the shaft and only the upper portion of the casing is depicted in FIG. 1.

The impeller 12 includes a plurality of impeller blades 12*a* arranged axisymmetrically around the latter shaft and defining a plurality of passages 12*b*. The impeller 12 discharges the pressurized gas into a diffuser passage, or channel, 14 defined between two annular facing interior walls 10*c* and 10*d* in the casing 10. The channel 14 extends radially outwardly from the impeller 12 and receives the high pressure gas from the impeller 12 before the gas is passed to a volute, or collector, 16 also formed in the casing 10 and in communication with the channel. The channel 14 functions to convert the velocity pressure of the gas into static pressure, and the volute 16 couples the compressed gas to an outlet (not shown) of the casing.

Due to centrifugal action of the impeller blades 12*a* and the design of the casing 10, gas entering the impeller passages 12*b* from the inlet 10*a* is compressed to a relatively high pressure. It is understood that conventional labyrinth seals, thrust bearings, tilt pad bearings and other similar hardware can also be provided in the casing 10 which are conventional and therefore will not be shown or described.

An annular plate 20 is mounted in a recess, or groove, formed in the interior wall 10*a*, with only the upper portion of the plate being shown, as viewed in FIG. 1. As better shown in FIG. 2, a plurality of discharge vanes 24 are angularly spaced around the plate 20, with each vane extending from the plate and at an angle to the corresponding radius of the plate. The plate 20 and the vanes 24 can be milled from the same stock or can be formed separately. The vanes 24 increase the efficiency of the apparatus by improving static pressure recovery in the diffuser channel 14, and since their specific configuration and function are conventional, they will not be described in further detail.

Figure 2:
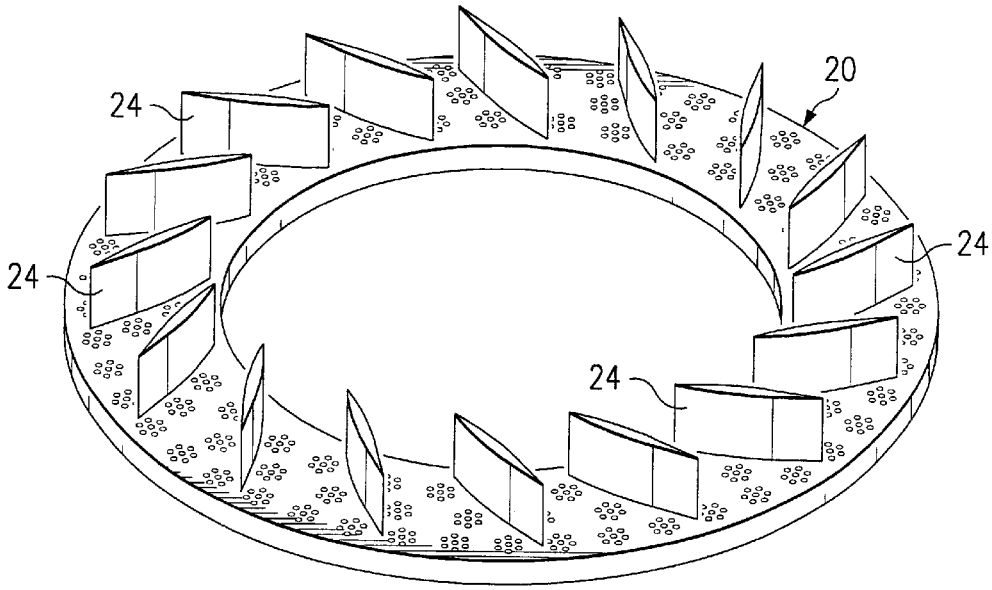
FIG. 2 is an isometric view of a base plate with a plurality of diffuser vanes used in the apparatus of FIG. 1.
Figure 3:
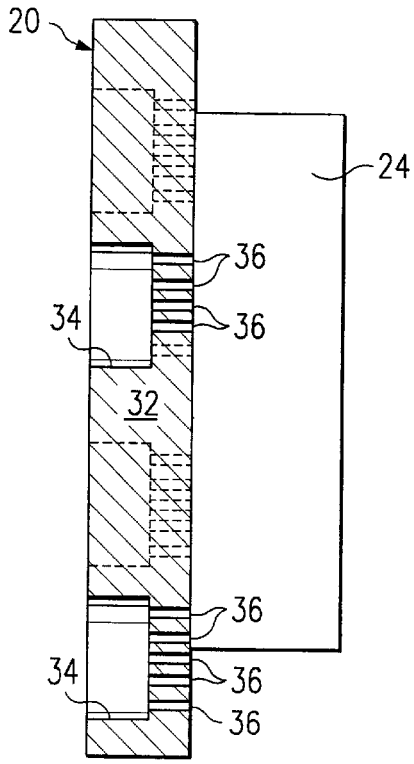
FIG. 3 is an enlarged view of a portion of the apparatus of FIG. 1.

As better shown in FIGS. 2 and 3, a series of relatively large cells, or openings, 34 are formed through one surface of the plate 20 between each pair of adjacent vanes 24. The cells 34 extend through a majority of the thickness of the plate 20 but not through its entire thickness. As shown in FIG. 3, a series of relatively small cells, or openings, 36 extend from the bottom of each cell 34 to the opposite surface of the plate 20. Each cell 34 is in the form of a bore having a relatively large-diameter cross section, and each cell 36 is in the form of a bore having a relatively small-diameter cross section, it being understood that the shapes of the cells 34 and 36 can vary within the scope of the invention. The cells 34 and 36 can be formed in any conventional manner such as by drilling counterbores through the corresponding surface of the plate 20. The cells 34 are capped by the underlying wall of the plate 20, and the open ends of the cells 36 communicate with the diffuser channel 14.

Preferably, the cells 34 are formed in a plurality of annular extending rows between each adjacent pair of diffuser vanes, with the cells 34 of a particular row being staggered, or offset, from the cells of its adjacent row(s). The cells 36 can be randomly disposed relative to their corresponding cell 34, or, alternately, can be formed in any pattern of uniform distribution.

In operation, a gas is introduced into the inlet 10*a* of the casing 10, and the impeller 12 is driven at a relatively high rotational speed to force the gas through the inlet 10*a*, the impeller passage, and the channel 14, as shown by the arrows in FIG. 1. Due to the centrifugal action of the impeller blades 12*a*, the gas can be compressed to a relatively high pressure. The channel 14 functions to convert the velocity pressure of the gas into static pressure, while the vanes 24 increase the efficiency of the operation by boosting static pressure recovery in the diffuser. The compressed gas passes through the channel 14 and the volute 16 and to the casing outlet for discharge.

Due to the fact that the cells 36 connect the cells 34 to the diffuser channel 14, the cells work collectively as an array of acoustic resonators which are either Helmholtz resonators or quarter-wave resonators in accordance with conventional resonator theory. This significantly attenuates the sound waves generated in the casing 10 in the area of the diffuser vanes 24 caused by the fast rotation of the impeller 12, and by its interaction with the diffuser vanes, and eliminates, or at least minimizes, the possibility that the noise bypass the plate 20 and pass through a different path.

Moreover, the dominant noise component commonly occurring at the passing frequency of the impeller blades 12*a*, or at other high frequencies, can be effectively lowered by tuning the cells 34 and 36 so that the maximum sound attenuation occurs around the latter frequency. This can be achieved by varying the volume of the cells 34, and/or the cross-sectional area, the number, and the depth of the cells 36. Also, given the fact that the frequency of the dominant noise component varies with the speed of the impeller 12, the number of the smaller cells 36 per each larger cell 34 can be varied spatially across the plate 20 so that noise is attenuated in a broader frequency band. Consequently, noise can be efficiently and effectively attenuated, not just in constant speed devices, but also in variable speed devices.

In addition, the employment of the acoustic resonators in the plate, as a unitary design, preserves or maintains a relatively strong structure which has less or no deformation when subject to mechanical and thermal loading. As a result, the acoustic resonators formed by the cells 34 and 36 have no adverse effect on the aerodynamic performance of the gas compression apparatus.

Variations and Equivalents

The specific technique of forming the cells 34 and 36 can vary from that discussed above. For example, a one-piece liner can be formed in which the cells are molded in their respective plates.

The vanes 24 can be integral with, or attached to, the plate 20.

The relative dimensions, shapes, numbers and the pattern of the cells 34 and 36 can vary.

The above design is not limited to use with a centrifugal compressor, but is equally applicable to other gas compression apparatus in which aerodynamic effects are achieved with movable blades.

The plate 20 can extend for 360 degrees around the axis of the impeller as disclosed above; or it can be formed into segments each of which extends an angular distance less than 360 degrees.

The spatial references used above, such as "bottom", "inner", "outer", "side" etc, are for the purpose of illustration only and do not limit the specific orientation or location of the structure.

Since other modifications, changes, and substitutions are intended in the foregoing disclosure, it is appropriate that the appended claims be construed broadly and in a manner consistent with the scope of the invention.

What is claimed is:

1. A gas compression apparatus comprising a casing having an inlet for receiving gas; an impeller disposed in the casing for receiving gas from the inlet and compressing the gas; a plate disposed in a wall of the casing; a plurality of vanes extending from the plate; and a plurality of cells formed in the plate to form an array of resonators to attenuate acoustic energy generated by the impeller.

2. The apparatus of claim 1 wherein a diffuser channel is formed in the casing, and wherein the plate is disposed in a wall in the casing defining the diffuser channel.

3. The apparatus of claim 2 wherein a volute is formed in the casing in communication with the diffuser channel for receiving the pressurized gas from the diffuser channel.

4. The apparatus of claim 1 wherein there is a first series of cells extending from one surface of the plate, and a second series of cells extending from the opposite surface of the plate to the first series of cells.

5. The apparatus of claim 4 wherein the size of each cell of the first series of cells is less than the size of the second series of cells.

6. The apparatus of claim 5 wherein the cells are in the form of bores formed in the plate, and wherein the diameter of each bore of the first series of cells is less than the diameter of the bore of the second series of cells.

7. The apparatus of claim 5 wherein a diffuser channel is formed in the casing, and wherein the first series of cells extend from the surface of the plate facing the diffuser channel.

8. The apparatus of claim 1 wherein the cells are uniformly dispersed in the plate between each adjacent pair of diffuser vanes.

9. The apparatus of claim 1 wherein the number and size of the cells are constructed and arranged to attenuate the dominant noise component of acoustic energy associated with the apparatus.

10. The apparatus of claim 1 wherein the resonators are either Helmholtz resonators or quarter-wave resonators.

11. Apparatus of claim 1 wherein the plate and the vanes are formed integrally.

12. A method of attenuating noise in a gas compression apparatus in which an impeller rotates to flow fluid through a casing and a plurality of vanes are mounted on a plate in the casing, the method comprising forming a plurality of cells in the plate to form an array of resonators to attenuate acoustic energy generated by the impeller.

13. The method of claim 12 wherein the step of forming comprises forming a first series of cells extending from one surface of the plate, and forming a second series of cells extending from the opposite surface of the plate to the first series of cells.

14. The method of claim 13 wherein the size of each cell of the first series of cells is less than the size of the second series of cells.

15. The method of claim 13 wherein the cells are in the form of bores formed in the plate, and wherein the diameter of each bore of the first series of cells is less than the diameter of the bore of the second series of cells.

16. The method of claim 12 wherein a diffuser channel is formed in the casing and wherein the first series of cells extend from the surface of the plate facing the diffuser channel.

17. The method of claim 15 further comprising the step of forming a volute in the casing in communication with the diffuser channel for receiving the pressurized gas from the diffuser channel.

18. The method of claim 12 wherein the cells form acoustic resonators and further comprising tuning the resonators to the impeller blade passing frequency and/or its harmonics to increase the attenuation.

19. The method of claim 18 wherein the step of tuning comprises varying the number, size and/or volume of the cells.

20. The method of claim 18 wherein the resonators are either Helmholtz resonators or quarter-wave resonators.

21. The method of claim 12 further comprising the step of uniformly dispersing the cells in the plate.

* * * * *